United States Patent [19]

Berthet

[11] 4,113,133

[45] Sep. 12, 1978

[54] ROLLED EDGE IN CANS

[75] Inventor: Andre Berthet, Bellegarde, France

[73] Assignee: Cebal, Paris, France

[21] Appl. No.: 757,135

[22] Filed: Jan. 6, 1977

Related U.S. Application Data

[63] Continuation of Ser. No. 595,772, Jul. 14, 1975, abandoned, which is a continuation of Ser. No. 366,492, Jun. 4, 1972, abandoned.

[30] Foreign Application Priority Data

Jun. 5, 1972 [FR] France ..... 70.20123

[51] Int. Cl.[2] ..... B65D 7/44

[52] U.S. Cl. ..... 220/74; 220/79

[58] Field of Search ..... 220/74, 73, 75, 79, 220/66, 67, 85 P; 428/121, 130; 113/129 K, 120 Y, 1 E, 120 L

[56] References Cited

U.S. PATENT DOCUMENTS

| | | | |
|---|---|---|---|
| 212,721 | 2/1879 | McKim | 220/74 |
| 278,271 | 5/1883 | Rice | 220/74 |
| 1,468,877 | 9/1923 | Colsman | 220/74 |
| 3,736,893 | 6/1973 | Coppens et al. | 220/67 |

FOREIGN PATENT DOCUMENTS

| | | | |
|---|---|---|---|
| 1,365,439 | 2/1964 | France | 220/67 |
| 915,642 | 1/1963 | United Kingdom | 220/74 |

*Primary Examiner*—William Price
*Assistant Examiner*—Joseph M. Moy
*Attorney, Agent, or Firm*—McDougall, Hersh & Scott

[57] ABSTRACT

An unrollable rolled edge in cans containing a product under pressure wherein a flat edge of the can is turned outwardly orthogonally and rolled within a rolled edge in which the radius of the rolled portion is less than the length of the flat edge confined therein in a plane passing through the axis of the can.

3 Claims, 7 Drawing Figures

ROLLED EDGE IN CANS

This is a continuation of application Ser. No. 595,772 filed July 14, 1975 (now abandoned), which is a continuation of application Ser. No. 366,492 filed June 4, 1973 (now abandoned).

This invention relates to an improvement in the formation of the rolled edge which, in aerosol type cans, surrounds the opening designed to receive the distribution valve.

The invention is addressed particularly to forming the edges of larger openings than those which are designed to receive conventional distribution valves standardized under the name "1 inch" in which the diameter at the base is 25.4 mm.

Valves of this kind are generally fixed by expansion, an operation which enables a cylindrical body to be fixed in a circular opening by increasing the diameter of the cylinder on either side of the edge of the opening.

In some cases, the valve has a more complex function to perform, which necessitates an increase in diameter at its base. This dimension has been standardized under the name "1½ inch" in which the diameter corresponds to an opening of 38.1 mm.

This is the case, for example, with cans generally referred to as "double-flux" aerosol cans, in which two separate components are accommodated in one can, one being contained in a flexible bag fixed to the valve, while the other surrounds the bag. The two products are subjected to the same pressure and are intermixed within the valve at the time of use. The complexity of this system necessitates a more voluminous valve body.

Such valves are fixed by crimping to the edge of the can which has previously been rolled outwardly.

Unfortunately, this system is faced with a problem: the force, applied through the internal pressure at the base of the valve, increases with the square of the radius of the opening in which it is fixed. The 50% increase in the diameter of this opening exposes the base of the valve to a force more than twice that applied to the conventional valve. In many cases, this internal force results in more or less pronounced unrolling of the edge of the can and resultant loosening of the crimp fit, thus enabling escape of fluid from within the container.

The object of this invention is addressed to a resolution of the problem of unrolling of the edge by providing it with a particular form.

These and other objects of this invention will hereinafter appear and for purposes of illustration, but not of limitation, an embodiment of the invention is shown in the accompanying drawings, in which.

The process for forming an aerosol can in which the rolled edge is unable to unroll comprises a reducing operation, known per se, for providing the opening of the can with the required diameter, turning back the free edge of the can orthogonally in relation to the wall of the can to form a stable flange, turning the flat flange back in a second operation to give it a frustoconical form and then rolling it in a final operation in a manner whereby it is situated within the rolled edge and its profile remains straight in a plane passing through the axis of the can.

The rolled edge, thus formed, cannot be unrolled despite extremely high internal pressures.

The invention is applicable to any pressurized can having a rolled edge in which the free end is provided with a straight profile that militates against unrolling. The length of this straight portion of the profile is preferably greater than the internal radius of the rolled part so as to resist unrolling.

The invention also relates to the apparatus employed and, more particularly, to the punch which turns the straight edge back along a frustoconical surface, having, as its axis, the axis of the can. This tool comprises a neck of triangular profile having one side parallel to the vertical wall of the reduced-diameter opening. The angle at the apex of the profile of the neck portion is preferably about 35°.

Figure 1:
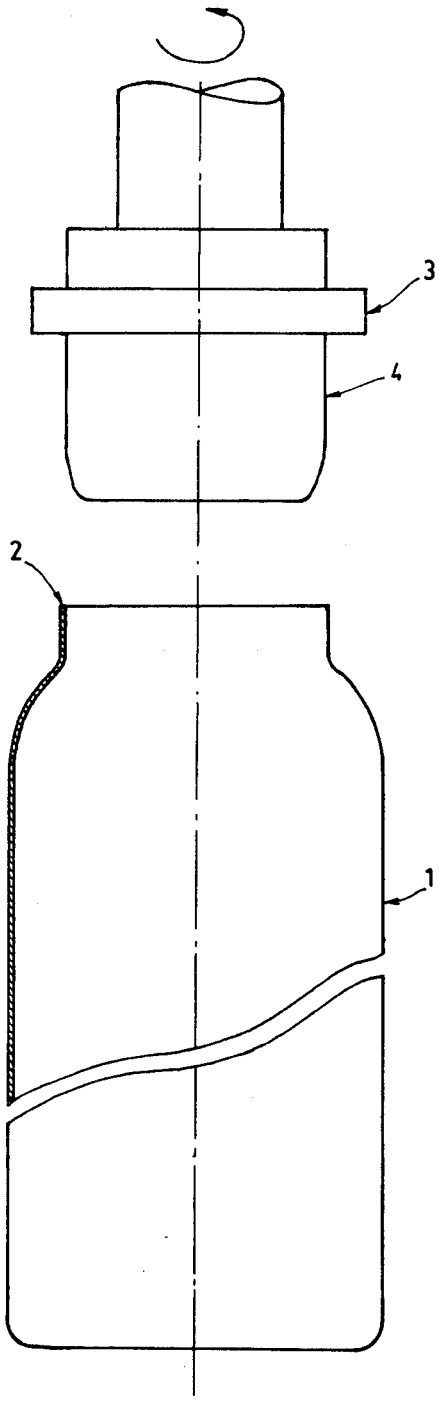
FIG. 1 is a schematic elevational view of the can at the completion of the operation which precedes processing in accordance with the practice of this invention.

Referring now to the drawings, the can 1, shown in FIG. 1, has already undergone the forming operation which reduced the internal diameter of the edge 2 to the required value, for example, 38.1 mm. The edge 2 has also been evened out by means of the rotary grinding tool 3, carrying a milling cutter mounted about a centering spigot 4.

Figure 2:
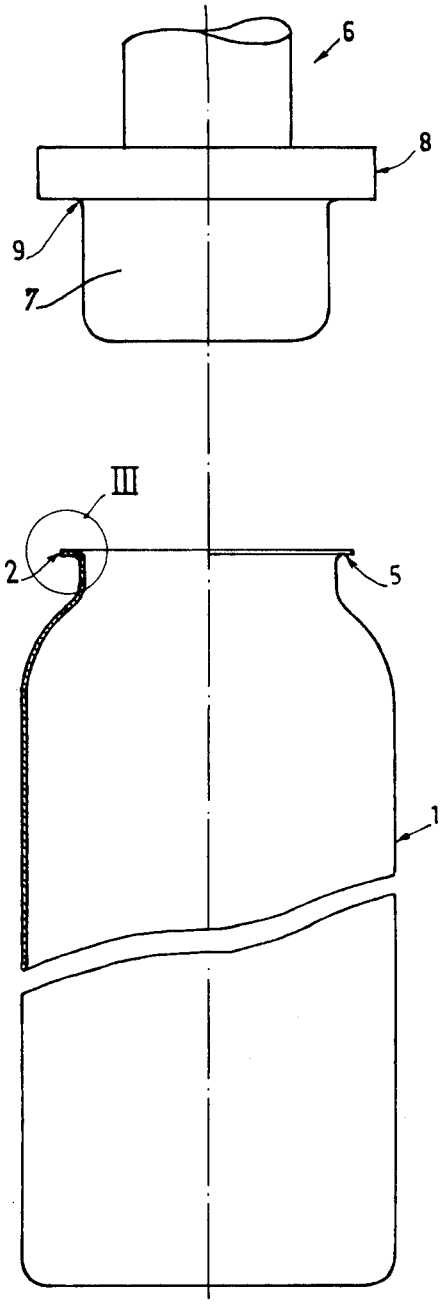
FIG. 2 is a sectional elevational view similar to that of FIG. 1 showing the can on completion of the first operation, including the tool used to carry out this operation.

The first operation, according to the invention (FIG. 2) comprises turning outwardly the upper edge portion 5 of the can 1 into a plane substantially perpendicular to the axis of the can 1.

This operation is carried out by means of the tool 6 which comprises a centering spigot 7 dimensioned to be received within the open top of the can 1, a ring 8 of larger cross sectional dimension than the open end of the top of the can 1, and a curvilinear neck portion 9 joining the underside of the ring 8 to the vertical wall of the spigot 7. The spigot 7 is used accurately to center the can 1 with respect to the tool 6. Towards the end of the downward stroke of the tool 6, the edge 2 of the can 1, about the open upper end, is deflected outwardly by the neck 9 and follows the underside of the ring 8 to extend radially substantially perpendicularly from the spigot wall 7.

Figure 3:
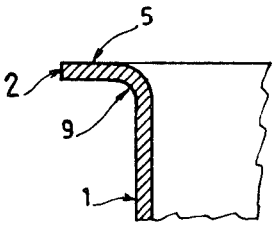
FIG. 3 is an enlarged sectional view of the corner portion of the can within the portion III of FIG. 2.

FIG. 3 shows the result of this operation in detail. A flange 5 of linear profile is formed to extend generally in the plane perpendicular to the axis of the can 1. The width of the flange can be varied, amounting to approximately 2.5 mm in the illustrated modification.

Figure 4:
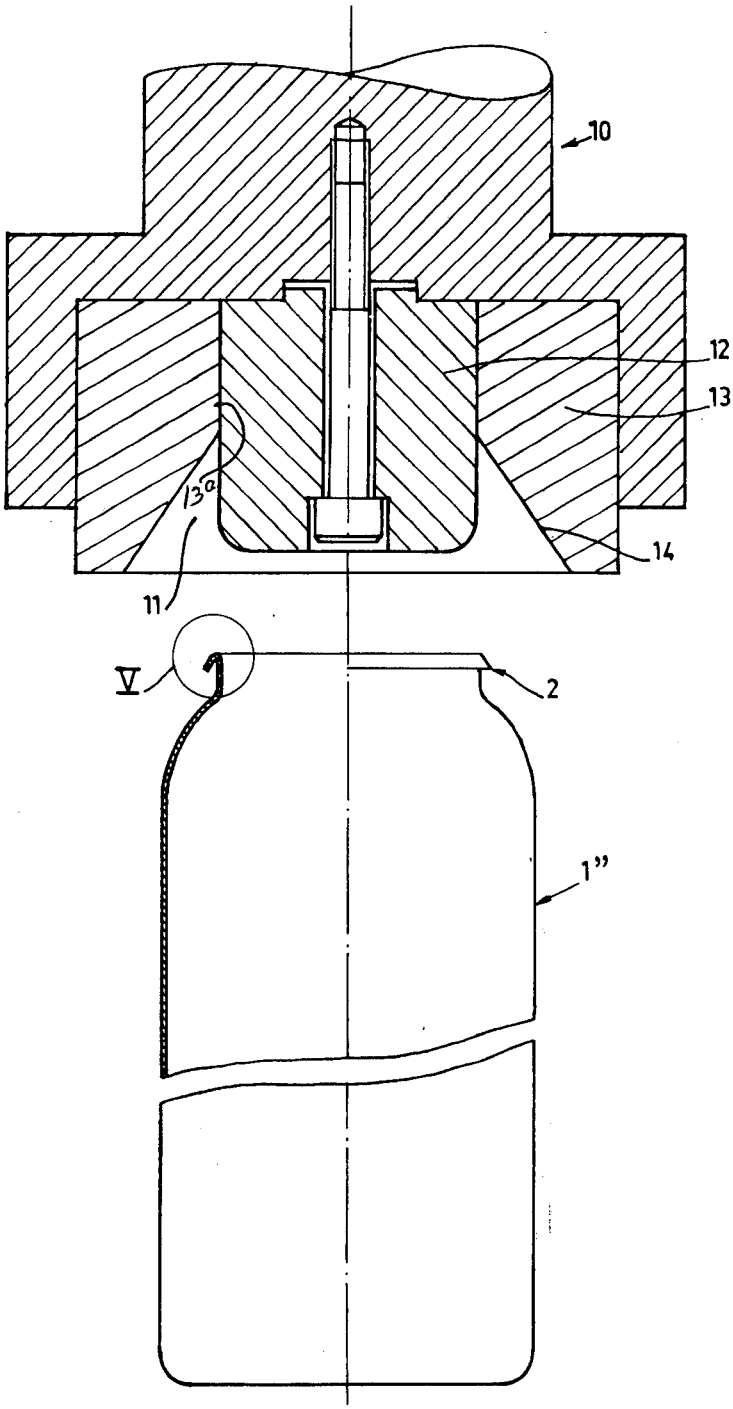
FIG. 4 is a sectional elevational view of the can after completion of the second opeaation of this invention and the tool used to carry out this invention.

The second operation (FIG. 4) is carried out with a different tool 10 which essentially provides a cavity 11 of triangular profile for forming the neck. To facilitate machining, the tool 10 is made up of several components interfitted one with another. In particular it comprises a center spigot 12, dimensioned to correspond with the spigot 7 and having an axially disposed side wall, and a hollow punch 13 having a central bore 13[a] dimensioned to receive the spigot in sliding relation and terminating in an inner wall extending outwardly at an oblique angle with the axis of the tool, such as at an angle of about 35° in the illustrated modification.

Figure 5:
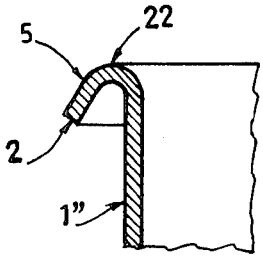
FIG. 5 is an enlarged sectional view of the corner portion identified by the numeral V in FIG. 4.

Upon descent of the tool in the direction toards the can 1, the outwardly extending flange portion 5 is engaged by the outer wall 14 of the triangular section to turn the flanged portion downwardly at a corresponding angle, without changing the shape of its profile. The flanged portion thus defines a frustoconical section extending at an angle of 35° with the vertical wall of the can (FIG. 5) and which is integrally joined to the can via a curvilinear section.

The tool 15, used for the third operation (FIG. 6), which provides the described portion of the can with its final shape, is somewhat more elaborate. The central section 16 comprises a terminal portion 17 which acts as a centering spigot and which terminates at its upper end with an annular, curvilinear, outwardly extending concave neck forming portion 18 of substantially semi-circular section, facing downwardly in the axial direction, the inner wall of which merges smoothly with the outer wall of the spigot 17, and having a diameter equal to the external diameter of the rolled edge of the can. The central portion 16 is entirely surrounded by a matrix 19 mounted for relative axial displacement relative to the central portion and to the tool holder 20. Means are provided constantly to urge the matrix 19 in the direction towards the inoperative-extended position. In the illustrated modification, such means comprises a coil spring 21 confined in a compressed state within a cavity, with one end of the coil spring in engagement with the tool holder 20 while the other bears against the back side of the matrix 19. In operative position, the matrix 19 is situated in an advanced position under the action of the several springs 21.

In response to movement of the tool assembly from inoperative position to operative position, the tool holder 20 descends and the matrix 19, the bore of which corresponds to the reduced-diameter shoulder of the can, comes into contact with the can to effect the desired centered relation, thus forestalling any possible deformation during the rest of the operation. For this purpose, the cavity portion of the matrix is formed at its upper end with an inwardly offset portion which corresponds to the contour of the can adjacent its upper edge, thereby to provide a backup support for the can during the subsequent shaping operation. As the tool holder 20 continues to descend, the springs 21 will be compressed until the neck 18 of the terminal portion 17 comes into contact with the top 22 of the edge of the can 1. Thereafter, the pressure of the tool 15 causes the vertical portion of the edge to be rolled from this apex line 22, in a manner known per se, to form a rolled portion having a radius which is less than the length of the linear flanged portion 5 which undergoes a rotation of more than 180°, while its linear profile remains unchanged.

Figure 6:
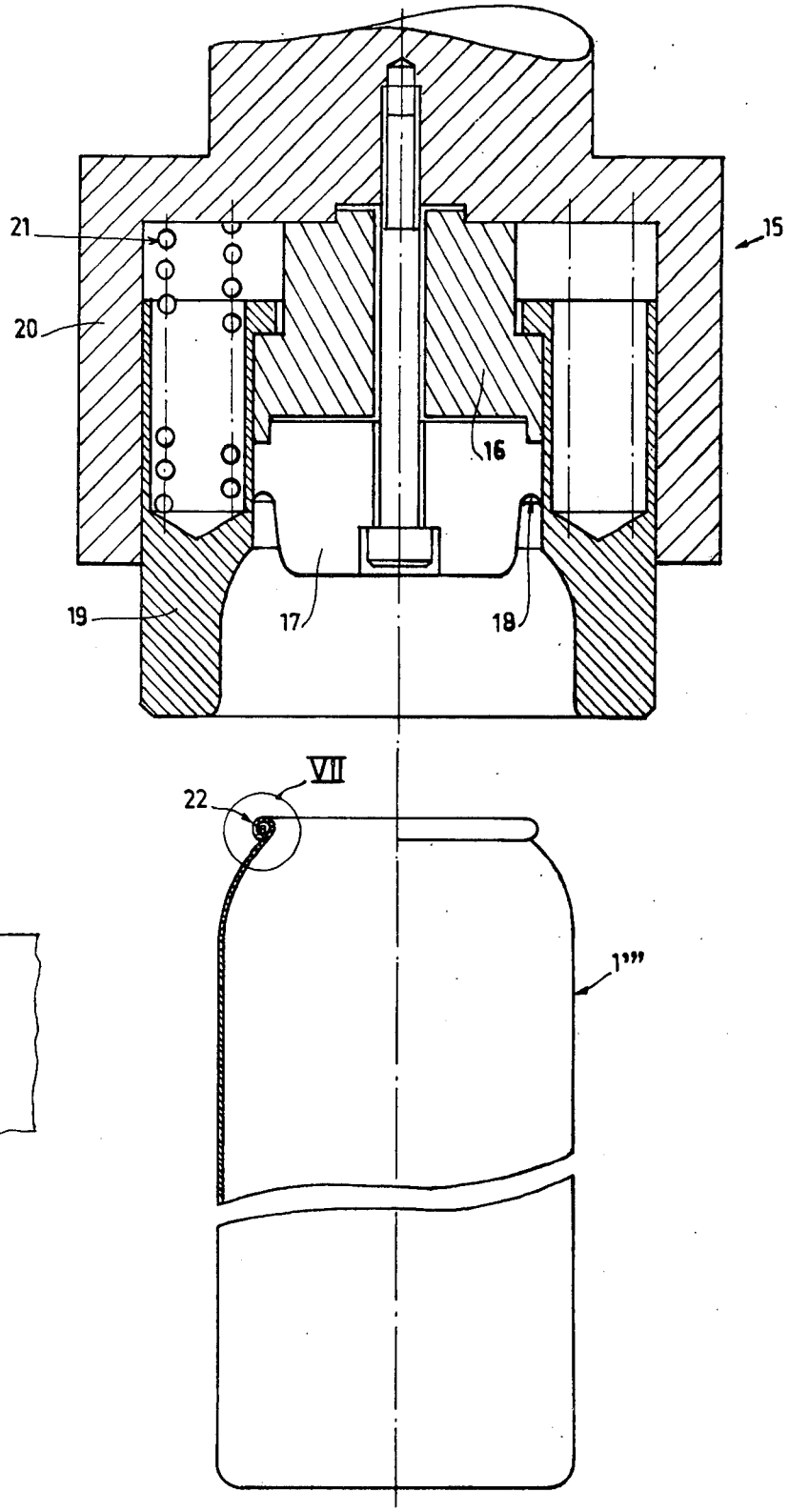
FIG. 6 is a sectional elevational view of the can after the third and last operation and the tool used to carry out this operation.
Figure 7:
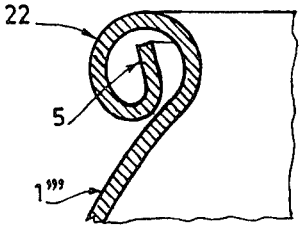
FIG. 7 is an enlarged sectional view of the corner portion VII in FIG. 6.

After this transformation, the vertical part surrounding the opening of the blank 1 at the beginning of the cycle has become enclosed within the rolled edge of the can (FIGS. 6 and 7). The width of the flange is preferably slightly greater than the internal radius of the rolled portion in which it is enclosed thereby to prevent the edge from being unrolled, despite the considerable force applied to the valve from within.

Apart from the application described above, the process of the invention has application in other structures wherein it is desired to prevent a rolled edge from being unrolled.

It will be understood that changes may be made in the details of construction, arrangement and operation without departing from the spirit of the invention, especially as defined in the following claims.

I claim:

1. A rolled edge can for accomodating a product under pressure, having a rim extending outwardly from the upper edge of the can in which the rim consists essentially of a straight end portion and a circular rolled portion joining the straight end portion with the upper edge of the can, said rolled portion defining a circular section of more than 180°, with the straight portion extending angularly from the circular rolled portion into the space within the circular section and dimensioned to have a length greater than the internal radius of the circular rolled portion in which it is confined so as to resist unrolling, and in which the profile of the straight end portion is along a plane which passes through the axis of the can.

2. A rolled edge can as claimed in claim 1 in which the straight end portion comprises a segment joined to the circular segment by a contiguous curvilinear band of about 65°.

3. A rolled edge can as claimed in claim 1 in which the straight end portion forms a frusto-conical section with respect to the axis of the can and from which the circular segment extends.

* * * * *